US005850935A

United States Patent [19]

Luburic et al.

[11] Patent Number: 5,850,935

[45] Date of Patent: Dec. 22, 1998

[54] CONTAINER WITH SHOULDER FLANGE AND REMOVABLE SIDEWALL PORTIONS, AND RELATED METHOD

[75] Inventors: Frano Luburic, Fullerton; Robert R. Roper, Mission Viejo, both of Calif.

[73] Assignee: Ropak Corporation, Fullerton, Calif.

[21] Appl. No.: 285,349

[22] Filed: Aug. 3, 1994

[51] Int. Cl.[6] ..... B65D 6/08

[52] U.S. Cl. ..... 220/675; 220/660; 220/890; 206/508; 206/519; 206/820; 229/101.1; 229/101.2; 426/130

[58] Field of Search ..... 220/660, 669, 220/672, 673, 675, 4.26, 8, 890; 206/508, 519, 820; 229/101.1, 101.2, 202, 932; 426/87, 115, 122, 129, 130, 414

[56] References Cited

U.S. PATENT DOCUMENTS

| | | | |
|---|---|---|---|
| 1,598,951 | 9/1926 | Wright | 426/130 |
| 2,401,417 | 6/1946 | Engle | 426/130 X |
| 2,717,619 | 9/1955 | Whitman | 229/101.1 |
| 2,852,179 | 9/1958 | Bieler | 426/130 X |
| 4,091,929 | 5/1978 | Krane | 426/122 |
| 4,971,215 | 11/1990 | Santoni | 206/519 X |
| 5,292,024 | 3/1994 | Koefelda et al. | 206/519 X |

FOREIGN PATENT DOCUMENTS

| | | | |
|---|---|---|---|
| 2195969 | 3/1974 | France | 229/101.1 |

*Primary Examiner*—Stephen K. Cronin
*Attorney, Agent, or Firm*—J. Mark Holland

[57] ABSTRACT

A container having a base and a sidewall portion extending upwardly therefrom is characterized by striations in the sidewall which define removable strips of the sidewall portion. A shoulder adjacent the opening of the container improves handling of the container, prevents or restricts undesired rotation of the container, restricts or preventing the flow of gas or liquid or solid from above the shoulder means to below the shoulder or vice versa, and stabilizes the containers when, for example, a plurality of them is arranged appropriately. A method of use of such containers is disclosed, including the steps of providing a plurality of such containers and arranging them appropriately.

20 Claims, 3 Drawing Sheets

CONTAINER WITH SHOULDER FLANGE AND REMOVABLE SIDEWALL PORTIONS, AND RELATED METHOD

BACKGROUND OF THE INVENTION

This invention relates to containers in general, and specifically to a container having removable portions of its sidewall and a shoulder ring near its opening, to provide many benefits for various applications.

In certain applications, it is useful to be able to remove portions of a container sidewall. Among other things, this improves access to the contents of the container and/or permits the contents to be processed in a manner that would otherwise be difficult.

By way of example, ice cream has been packaged in paper containers in a tubular shape. Among the uses of such containerized ice cream are scooping the ice cream therefrom and placing it on cones or in bowls (very traditional applications), and slicing the ice cream into layers by the use of a thin wire or sharp knife (a less traditional application). The paper sidewall of the container permits the slicing to occur at any selected height, but can involve contamination of the ice cream with paper scraps, and can otherwise be rather messy as the paper sidewall might become soft and wet.

In addition, when a plurality of such prior art ice cream containers are placed in a refrigerated display cabinet, the gaps between the containers can result in the containers spinning and/or otherwise being rather unstable. This is especially the case during the sometimes aggressive scooping of ice cream therefrom, and also if the containers soften as the ice cream might cause the paper to become wet. In addition, ice cream or other materials can be accidentally dropped into those gaps between the containers, and in many common arrangements, it is difficult to clean between the containers.

Prior art attempts to solve the spinning and/or instability problems include a planar shoulder rack (typically a molded layer of plastic with a plurality of appropriately sized and spaced openings therein to correspond to the containers) placed about the openings of the containers and abutting the sides of the refrigerated cabinet. Among other things, this stabilizes the containers, helps prevent materials from undesirably being dropped between the containers, and reduces the energy transfer between the cold air below the shoulder rack and the typically warmer air above the rack (that is, the ambient room temperature air).

Regarding spinning, some prior art systems incorporate mating engagement means on the containers and shoulder racks (such as interfitting ribs on the containers and slots on the shoulder racks) to lock the container against undesired spinning.

Such prior art shoulder racks have various shortcomings, however. For example, most freezer cabinets must be modified to support the shoulder racks at the desired height along the sidewall. In addition, retail ice cream stores commonly stack their paperboard tubular ice cream containers "two-high", with the upper layer of containers open for scooping ice cream therefrom. When one of the upper containers needs to be replaced, the prior art systems can be relatively cumbersome. With the aforementioned shoulder racks, the user must remove all containers from the operative shoulder rack, remove the rack from the cabinet, remove the second (lower) tier container (it will become the upper opened container), insert a new container as the second (lower) tier container, replace the rack, and then place the former lower tier container into the rack. Thus, replacement or removal of the individual ice cream containers from the shoulder rack can be awkward.

Other attempts to prevent spinning of the containers during scooping include placing a band or strap about a plurality of such containers and tightening it so that friction and the weight of the containers prevents the rotation. Again, replacement of containers can be cumbersome because it involves multiple containers and the manipulation of the band/strap, sometimes at relatively awkward angles.

Moreover, it can be difficult to handle the prior art paperboard tubular containers, such as when loading them into, and removing them from, the refrigerated case.

Additionally, retail outlets using prior art paperboard containers as described above for ice cream sales typically try to measure the remaining ice cream at the end of each shift. Commonly, this is accomplished by using a pole or stick having height measures thereon to measure the height of the remaining ice cream. The pole or stick must be inserted into each container and the scale thereon read by the measurer.

OBJECTS AND ADVANTAGES OF THE INVENTION

It is, therefore, an object of our invention to provide an improved container characterized by a base portion and a sidewall portion extending upwardly therefrom when the container is in its normally upright position, in which the sidewall portion includes one or more primary scorelines or striations for selectively tearing from the sidewall portion corresponding sub-portions of the sidewall portion. In the preferred embodiment, the container and its sidewall are formed from injection-molded plastic and the sidewall includes scorelines formed therein.

In addition, the one or more primary scoreline means are preferably horizontal when the container is in its normally upright position, and the scorelines or striations extend completely about the periphery of the sidewall portion. Among other things, this assists in the aforementioned slicing of any solid contents of the containers (such as the ice cream described above), and even provides a relatively sturdy slicing guide (in the form of the torn edge remaining at the upper end of the sidewall) for more accurately preparing the slices.

A further object of our invention to provide an improved container of the aforementioned character, further including one or more supplementary scoreline means extending between the one or more primary scoreline means. The supplementary scorelines assist in initiating the tearing of the respective sub-portion or sub-portions from the sidewall portion. In the preferred embodiment, the one or more supplementary scoreline means are vertical when the container is in its normally upright position.

Yet another object of our invention the provision of an improved container of the aforementioned character, further including shoulder means operatively attached to the sidewall portion and extending outwardly therefrom. These shoulder means provide many of the benefits of the above described prior art shoulder racks, but provide many important additional advantages as well. Among other things, the preferred shoulder means of the invention are operatively affixed to the container sidewall, and are modular (rather than a unitary rack operatively engaging a number of containers, the preferred embodiment of the container contains its own shoulder means). When a plurality of such similarly-sized and shaped containers are provided and assembled properly, they can improve the usability of such a system over that achievable with the above-described prior art, including improving the ease of cleanup, removal and insertion of containers, and related functions.

The shoulder means is preferably located near the upper edge of the container, and is similarly fabricated from injection-molded plastic. It preferably extends about the periphery of the container in a plane which is horizontal when the container is in its normally upright position.

Another object of our invention is the provision of a container or bucket of the aforementioned character which is nestable and stackable with other similarly sized and shaped buckets or containers.

An additional object of our invention is the provision of a method of storage of materials, including the steps of providing a plurality of containers of the aforementioned character, and arranging the containers so that adjacent of the shoulder means abut one another. Among other things, this provides many benefits in certain applications, such as those described hereinabove.

Other objects and advantages of the invention will be apparent from the following specification and the accompanying drawings, which are for the purpose of illustration only.

DESCRIPTION OF PREFERRED EMBODIMENT

Figure 1:
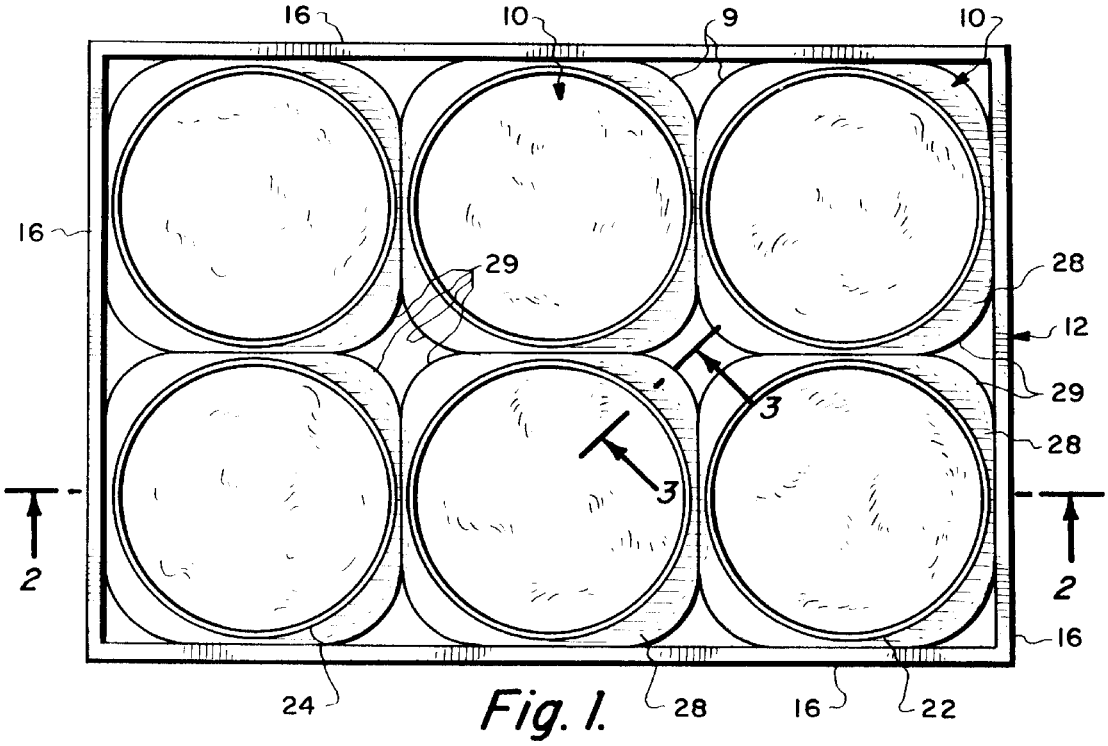
FIG. 1 is a plan view of a preferred embodiment of a plurality of containers constructed and assembled in accordance with the teachings of the invention.
Figure 2:
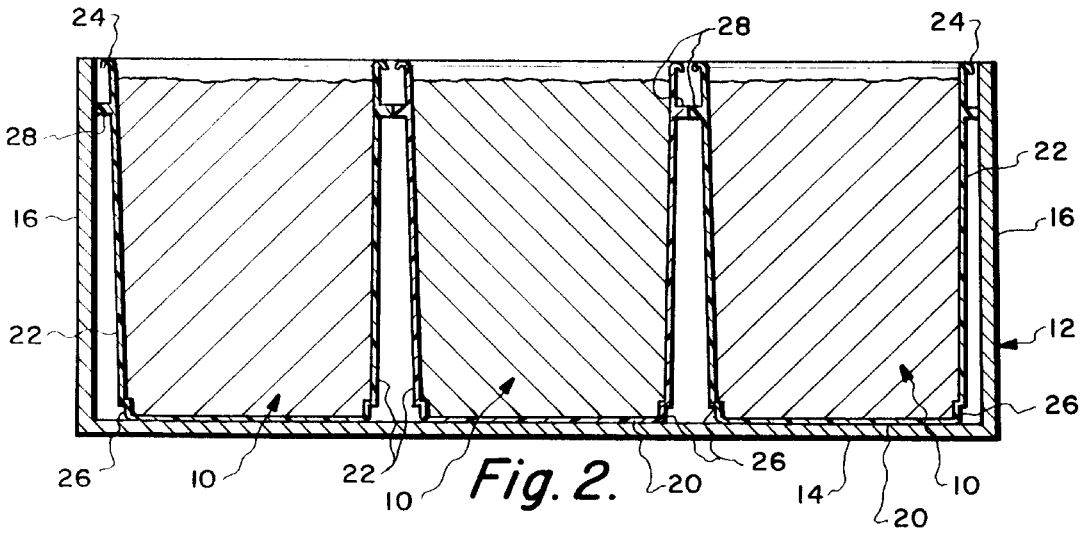
FIG. 2 is a sectional view taken along line 2—2 of FIG. 1.
Figure 3:
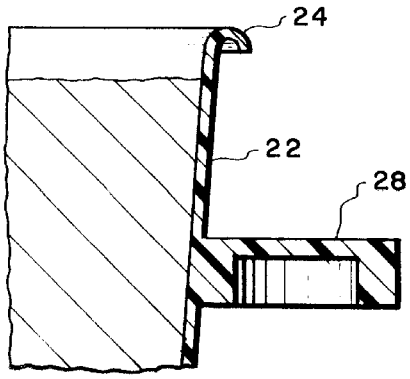
FIG. 3 is a broken sectional view taken along line 3—3 of FIG. 1.

Referring now to the drawings, and particularly to FIGS. 1–3 thereof, we show a preferred embodiment of a plurality of containers 10 assembled with each other in a case 12 such as a refrigerated display case or the like. The case 12 typically includes a bottom 14 and sides 16. Although the drawings illustrate six containers arranged in a 2×3 grid, persons of ordinary skill in the art will understand that many other arrangements of containers can be readily configured within the scope of our invention.

In the preferred embodiment, the containers 10 and each of them are fabricated from injection-molded plastic by any suitable technique. Each container 10 preferably includes a bottom portion 20 with a sidewall portion 22 extending upwardly therefrom. The upper end 24 of the sidewall portion defines an opening into the container 10.

The sidewall portion 22 preferably is sloped (from narrower near the bottom of the container to wider near the upper edge of the container) so that it can be nested with other such containers when empty. This nestability is beneficial for shipping a plurality of these containers prior to them being filled, for example, or for shipping the containers for regrind after use (where the sidewall has not been completely torn into strips, as discussed herein).

Each container 10 is preferably provided with peripheral shoulder means or external ring means 28 operatively attached to the sidewall portion 22 and extending outwardly therefrom. The preferred shoulder means 28 extends about the periphery of the container in a plane which is horizontal when the container is in its normally upright position. Among other things, the shoulder means 28 aids in handling the containers, prevents or restricts rotation or other movement of the containers, helps prevent the container 10 from being tipped over, and/or restricts or prevents the flow of gas or liquid or solid from above the shoulder means to below the shoulder means or vice versa (this helps reduce the temperature exchange and the consequent energy required to refrigerate the containers in certain applications).

The shoulder means 28 are preferably formed integrally with the container sidewall 22, are positioned adjacent the upper edge of the containers 10, and are configured to abut adjacent containers 10 and/or adjacent structures such as case walls 16, FIGS. 1 and 2.

Among the alternative embodiments (not shown) of the invention, the shoulder means could be formed as a separate component (rather than integrally with the sidewall). Such separate shoulder means could be friction fitted against the sidewall (by sizing the shoulder means with an opening larger than the bottom 20 of the container 10 but smaller than the upper edge 24), spin-welded in the desired position, or otherwise affixed to the sidewall.

The preferred external ring means 28 is of generally rectangular external shape, with foreshortened corners 29. The rectangular external shape helps immobilize the container against rotation or the like when the flat portions thereof abut other containers or structures such as the sides of a refrigerated case.

The foreshortened corners 29 permit ready removal and insertion of the containers into various arrangements, such as illustrated in FIG. 1. In such an arrangement, each individual container 10 may be grasped at those corners 29 to facilitate removal or insertion of the container.

Moreover, the provision of external ring means 28 generally improves the convenience and ease of handling of the containers, during transportation, stacking and positioning on pallets, etc.

Figure 4:
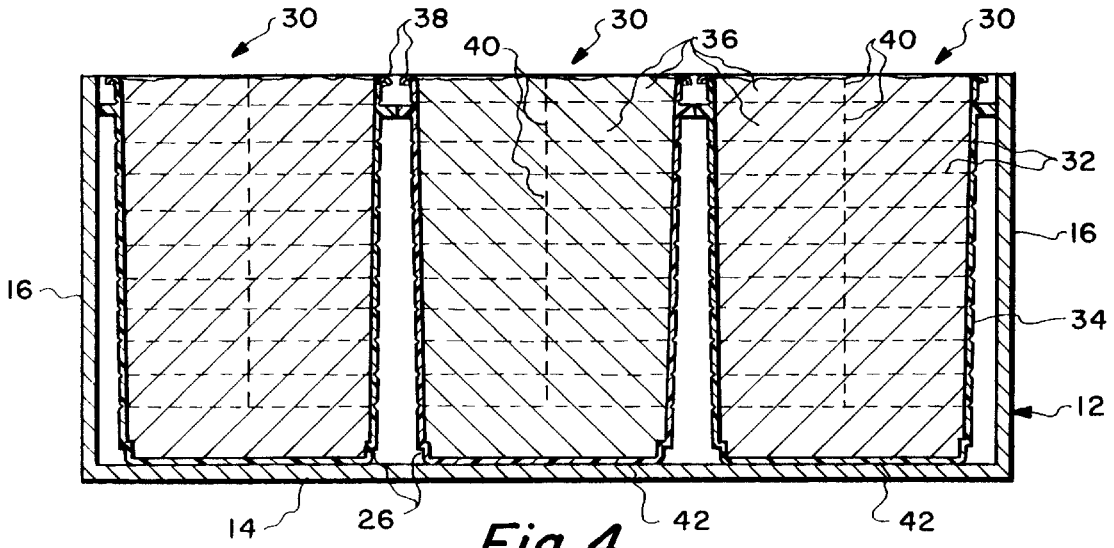
FIG. 4 is a sectional view similar to FIG. 2, but illustrating scoreline means or striations in the sidewall portion.
Figure 5:
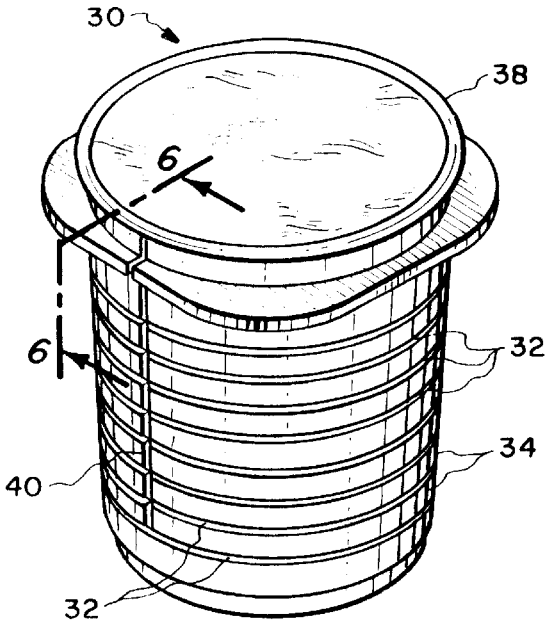
FIG. 5 is an isometric view of a preferred embodiment of a container constructed and fabricated in accordance with the invention.
Figure 6:
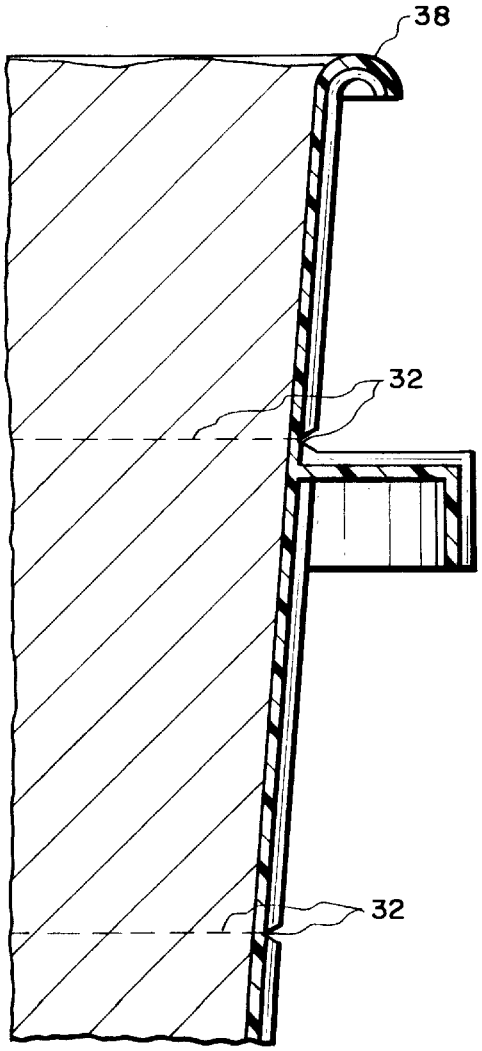
FIG. 6 is a broken sectional view taken along line 6—6 of FIG. 5.

As shown in FIGS. 4–6, the many alternative embodiments of the container include, by way of example, containers 30 having one or more primary scorelines means 32 for selectively tearing from the sidewall portion 34 corresponding sub-portions 36 (see FIGS. 7–9) of the sidewall portion 34. In most other regards, the containers 30 are identical to those described above as containers 10 in FIGS. 1–3.

As indicated in FIGS. 4–6, the preferred container 30 includes primary scoreline means 32 which are horizontal when the container is in its normally upright position, and which extend completely about the periphery of the sidewall portion. persons of ordinary skill in the art will understand, however, that other orientations and arrangements of such lines can be utilized with efficacy.

The preferred sidewall portion 34 also includes an upper edge 38 thereof, and further including one or more supplementary scoreline means or striations 40 extending between the upper edge 38 and the one or more primary scoreline means 32 (or between adjacent pairs of the primary scoreline means 32), for initiating tearing of the respective sub-portion 36 from the sidewall portion 34. In the illustrated embodiment, the one or more supplementary scoreline means 40 are vertical when the container 30 is in its normally upright position.

persons of ordinary skill in the art will understand that the aforementioned primary scorelines constitute first striations which divide the sidewall into two or more strips. The first striations constitute selectable tear lines for removing material above each such selected line from the sidewall portion. In the illustrated embodiment, bottom 42 of the container or bucket 30 generally defines a first plane and the first striations define planes generally parallel to the first plane.

A preferred method of storage of materials includes the steps of providing a plurality of containers of the type described above, in similarly sized and shaped embodiments, and arranging the containers so that adjacent of the shoulder means abut one another. Those skilled in the art will understand that such ofmethod permits the use of such containers in many applications, including the icecream containerization and dispense applications described herein.

Figure 7:
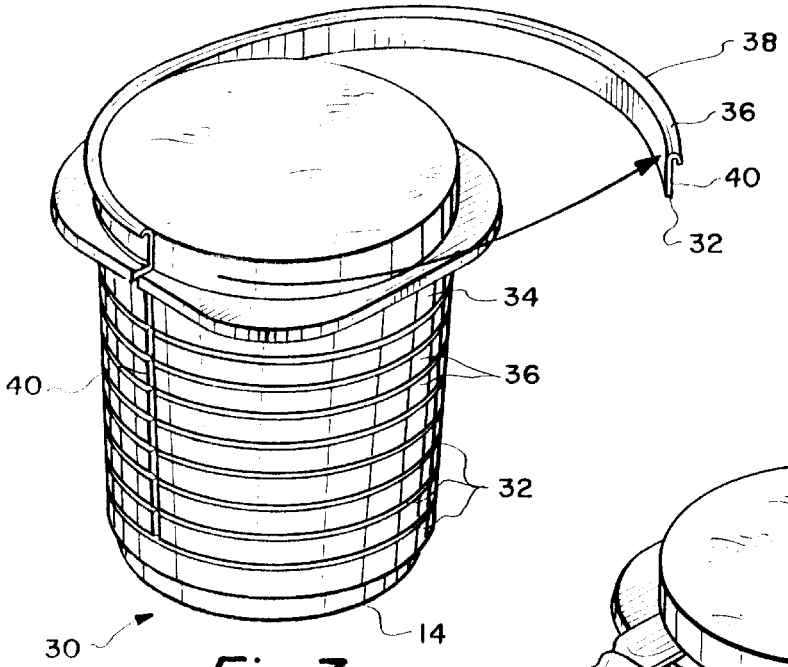
FIG. 7 is an isometric view similar to FIG. 5, but illustrates the removal of a first strip of sidewall portion or sub-portion.
Figure 8:
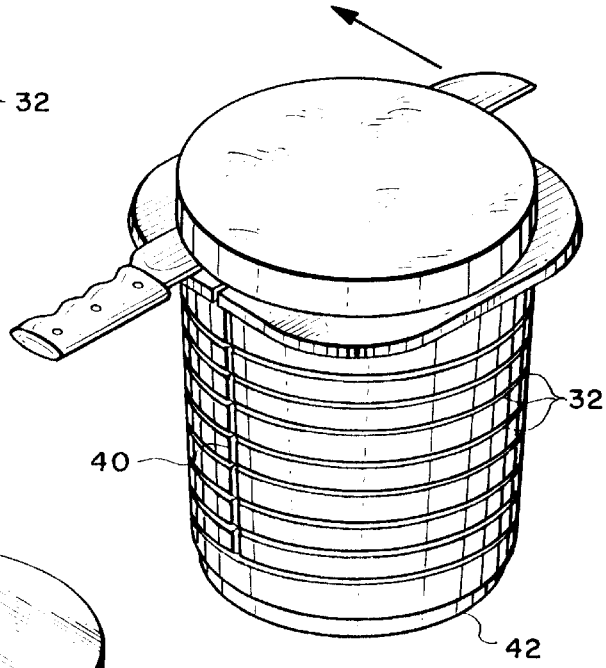
FIG. 8 is similar to FIG. 7, but illustrates the slicing of the contents of the container.
Figure 9:
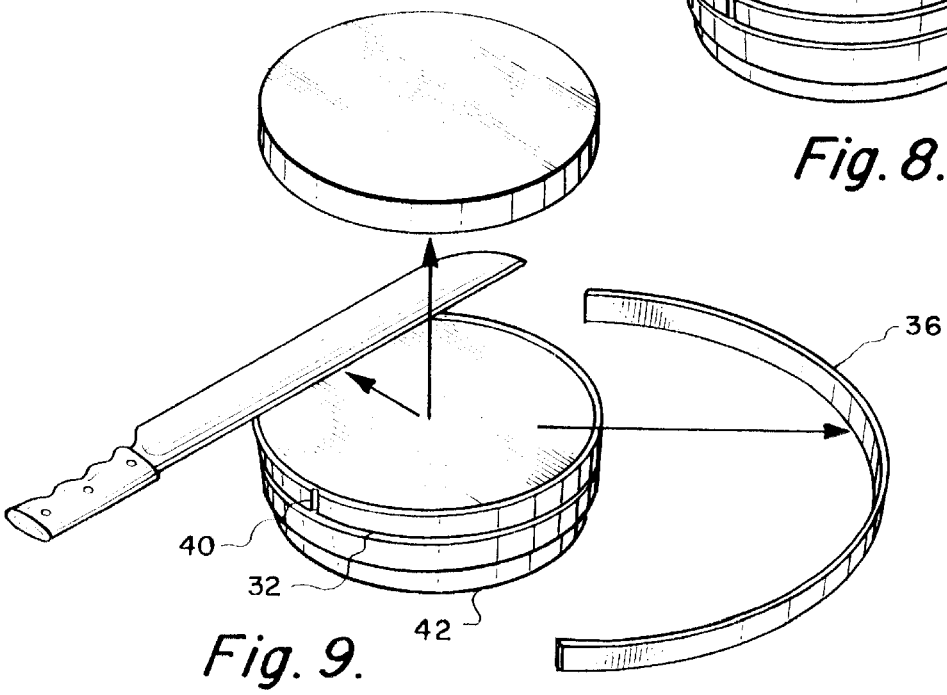
FIG. 9 illustrates slicing and removal of lower layers of the contents of the container.

An example of the removal of the strips and slicing of the contents is illustrated in FIGS. 7–9. The uppermost strip containing the upper edge 38 is preferably removed by initiating a tear along secondary scoreline or striation 40 and continuing the tearing action along uppermost primary scoreline 32. The spacing of tearlines 32 along the sidewall 34 can be any expedient spacing, including varying spacing within a single container sidewall.

The newly-exposed upper edge of the tearline can be utilized as a guide for slicing, FIG. 8, and layers below the uppermost can be sliced and removed by similar process, as indicated in FIG. 9. Multiple strips 36 can be removed at one time by tearing further down secondary scoreline 40 before initiating a horizontal tear along a selected scoreline 32. In the illustrated embodiment, the shoulder means is removed with the second-highest strip 36.

Although the preferred embodiment includes removing one or more tearstrips 36 prior to slicing and removing the contents of the container, the sidewall 34 is preferably fabricated from a material that can be readily cut through by an appropriate knife or other tool (cutting at the thinner scorelines would require less effort, however). This permits the slicing to occur at any height and angle along the sidewall and leaves the tearstrips 36 intact in an encircling relationship about the adjacent contents of the container. Such intact rings may be removed with the sliced portion of the contents, helping maintain the shape, temperature, etc. of the slice. For example, where the contents are ice cream, the intact ring 36 can aid in handling the slice and/or in slowing the rate of melting of the slice.

As indicated above, some applications require that the height of the remaining contents of the container be measured periodically. The container of our invention can be utilized effectively in this regard, either by providing the scorelines 32 at predetermined heights along the sidewall, and/or by engraving a scale (not shown) into the sidewall. The scale could include, for example, numbers, units, letters, or other indicia. Either of these height-indicating means, and/or the combination of the two of them, can permit persons to satisfactorily gauge the height of the remaining contents of the container.

In addition, persons of ordinary skill in the art will understand that, although the drawings illustrate the containers 10 and in a round tubular configuration, the invention may be practiced with other, non-circular configurations.

In addition, the preferred containers are nestable with each other for reduced volume during shipping before the containers are filled. By providing a lid (not shown) to cover the opening in each container 10, the containers and lids can be readily stacked one upon the other. This stacking can be enhanced by the provision of corresponding stacking means 26 at the foot of each container 10, to matingly engage corresponding means in the lids or covers of adjacent lidded containers.

Thus, by our invention, we provide an improved container and method for storage and dispense of materials.

The apparatus and method of our invention have been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

We claim:

1. A container having a base portion and a sidewall portion extending upwardly therefrom when said container is in its normally upright position, said sidewall portion including one or more primary scorelines means for selectively tearing from said sidewall portion corresponding sub-portions of said sidewall portion, said container being nestable with other like containers of the same size, further including shoulder means operatively attached to said sidewall portion and extending outwardly therefrom, to aid in handling the containers, to prevent or restrict rotation or other movement of the containers, to help prevent said container from being tipped over, and to restrict or prevent the flow of gas or liquid or solid from above said shoulder means to below said shoulder means or vice versa.

2. The container of claim 1, in which said one or more primary scoreline means are horizontal when said container is in its normally upright position, and which extend completely about the periphery of said sidewall portion.

3. The container of claim 2, in which said container is fabricated by injection molding.

4. The container of claim 1 or claim 2 or claim 3, in which said sidewall portion includes an upper edge thereof, and further in which said shoulder means is located near said upper edge.

5. The container of claim 1 or claim 2 or claim 3, in which said shoulder means extends about the periphery of said container in a plane which is horizontal when said container is in its normally upright position.

6. The container of claim 1 or claim 2 or claim 3, in which said sidewall portion includes an upper edge thereof, and further including one or more supplementary scoreline means extending between said upper edge and said one or more primary scoreline means, for initiating tearing of said respective sub-portion from said sidewall portion.

7. The container of claim 6, in which said one or more supplementary scoreline means are generally vertical when said container is in its mormally upright position.

8. A plastic, injection-molded bucket having a bottom and a sidewall portion extending upwardly therefrom and defining an opening, in which said sidewall portion includes first striations therein dividing said portion into two or more strips, said first striations constituting selectable tear lines for removing material above such selected line from said sidewall portion, said container being nestable with other like containers of the same size, further including external ring means adjacent said opening and extending peripherally therefrom to aid in handling the containers, to prevent or restrict rotation or other movement of the containers, for contacting adjacent buckets or structures to support said bucket, and to restrict or prevent the flow of gas or liquid or solid from above said shoulder means to below said shoulder means or vice versa.

9. The bucket of claim 8 in which said bottom generally defines a first plane and said first striations define planes generally parallel to said first plane.

10. The bucket of claim 8 further including secondary striations constituting tear lines intersecting said first striations.

11. A plastic, injection-molded bucket having a bottom and a sidewall portion extending upwardly therefrom and defining an opening, said container being nestable with other like containers of the same size, in which said sidewall portion includes external ring means adjacent said opening and extending peripherally therefrom to aid in handling the containers, to prevent or restrict rotation or other movement of the containers, for contacting adjacent buckets or structures to support said bucket, and to restrict or prevent the flow of gas or liquid or solid from above said shoulder means to below said shoulder means or vice versa, in which said sidewall portion includes first striations therein dividing said portion into two or more strips, said first striations constituting selectable tear lines for removing material above such selected line from said sidewall portion.

12. The bucket of claim 11, in which said external ring means is formed separately from said sidewall portion and is subsequently operatively assembled therewith.

13. The bucket of claim 11 or claim 12, in which said bottom generally defines a first plane and said first striations define planes generally parallel to said first plane.

14. The bucket of claim 11 or claim 12, further including secondary striations constituting tear lines intersecting said first striations.

15. The bucket of claim 11 claim 12, including a mating lid to cover the opening of said bucket, in which said bucket is stackable with other similarly sized and shaped buckets having similar lids thereon.

16. The bucket of claim 11 or claim 12, including height-indicating means on said sidewall portion, in which said height-indicating means includes said first striations.

17. The bucket of claim 11 or 12, in which said external ring means is of generally rectangular external shape, with foreshortened corners.

18. The bucket of claim 11 or claim 12, including height-indicating means on said sidewall portion.

19. The bucket of claim 18, in which said height-indicating means includes indicia engraved on said sidewall.

20. A method of storage of materials, including the steps of: providing a plurality of similarly sized and shaped containers, each of said containers being nestable with other like containers of the same size and having a bottom and a sidewall portion extending upwardly therefrom and defining an opening, said sidewall portion further including first striations therein dividing said portion into two or more strips, said first striations constituting selectable tear lines for removing material above such selected line from said sidewall portion, further including external ring means adjacent said opening and extending peripherally therefrom for contacting adjacent structures; providing material to said containers; and arranging said containers so that adjacent of said external ring means abut one another, thereby aiding in handling the containers, preventing or restricting rotation or other movement of the containers, and restricting or preventing the flow of gas or liquid or solid from above said external ring means to below said external ring means or vice versa.

* * * * *